US005988991A

United States Patent [19]

Tsai

[11] Patent Number: 5,988,991

[45] Date of Patent: Nov. 23, 1999

[54] SIMPLIFIED ENERGY TRANSFORMING STRUCTURE

[76] Inventor: Jui-An Tsai, 4th Floor, No. 7, Lane 3, Wu Shou Hsin Tsuen, Chung Kang Road, Hsin Chuang City, Taipei Hsien, Taiwan

[21] Appl. No.: 09/045,859

[22] Filed: Mar. 23, 1998

[51] Int. Cl.[6] ..... F04B 17/00

[52] U.S. Cl. ..... 417/328; 417/329

[58] Field of Search ..... 417/328, 329, 417/298, 244

[56] References Cited

U.S. PATENT DOCUMENTS 1,459,645 6/1923 Wilson ..... 60/640
4,229,143 10/1980 Pucher et al. ..... 417/53
4,246,756 1/1981 West ..... 60/640
4,265,599 5/1981 Morton ..... 417/54
4,586,333 5/1986 Reid ..... 60/506

*Primary Examiner*—Tu Ba Hoang
*Assistant Examiner*—Vinod D. Patel
*Attorney, Agent, or Firm*—Bacon & Thomas

[57] ABSTRACT

Disclosed is a simplified energy transforming structure which utilizes the weight of water stored at high position to pull up a heavy piston in a hydraulic cylinder, so that the piston can thereafter descend due to gravity and forces water flowing into the hydraulic cylinder to pass a predetermined passage toward a functional device in the form of high pressure water full of kinetic energy, causing the functional device to operate and achieve a desired function.

2 Claims, 5 Drawing Sheets

SIMPLIFIED ENERGY TRANSFORMING STRUCTURE

BACKGROUND OF THE INVENTION

The earth provides us with very rich water resource and it would be a thousand pities if we do not fully utilize this natural water resource and simply let it flow quietly. Although there are already numerous hydroelectric generation systems and dams all over the world to make good use of natural waters to generate power, these power stations and dams are structurally and financially huge and can not be miniaturized and simplified for use in a simple manner.

A water wheel is an example of simple device to utilize energy provided by water flows. However, since the water wheel operates in a completely open space, a large part of energy provided by water flows is lost. That is, not all the existing and stored water energy can be efficiently transformed by the water wheel into useful power.

It is therefore tried by the inventor to develop a simplified energy transforming structure for use at proper place to fully transform water energy into useful power in a simple and convenient manner.

SUMMARY OF THE INVENTION

The present invention relates to a simplified energy transforming structure having a water supply tank and a heavy piston disposed in a hydraulic cylinder separately connected to two ends of a pulley assembly. The water supply tank and the heavy piston automatically and alternately ascend and descend at two ends of the pulley assembly to complete transformation of potential energy into kinetic energy for works.

DETAILED DESCRIPTION OF THE PREFERRED EMBODIMENTS

Figure 1:
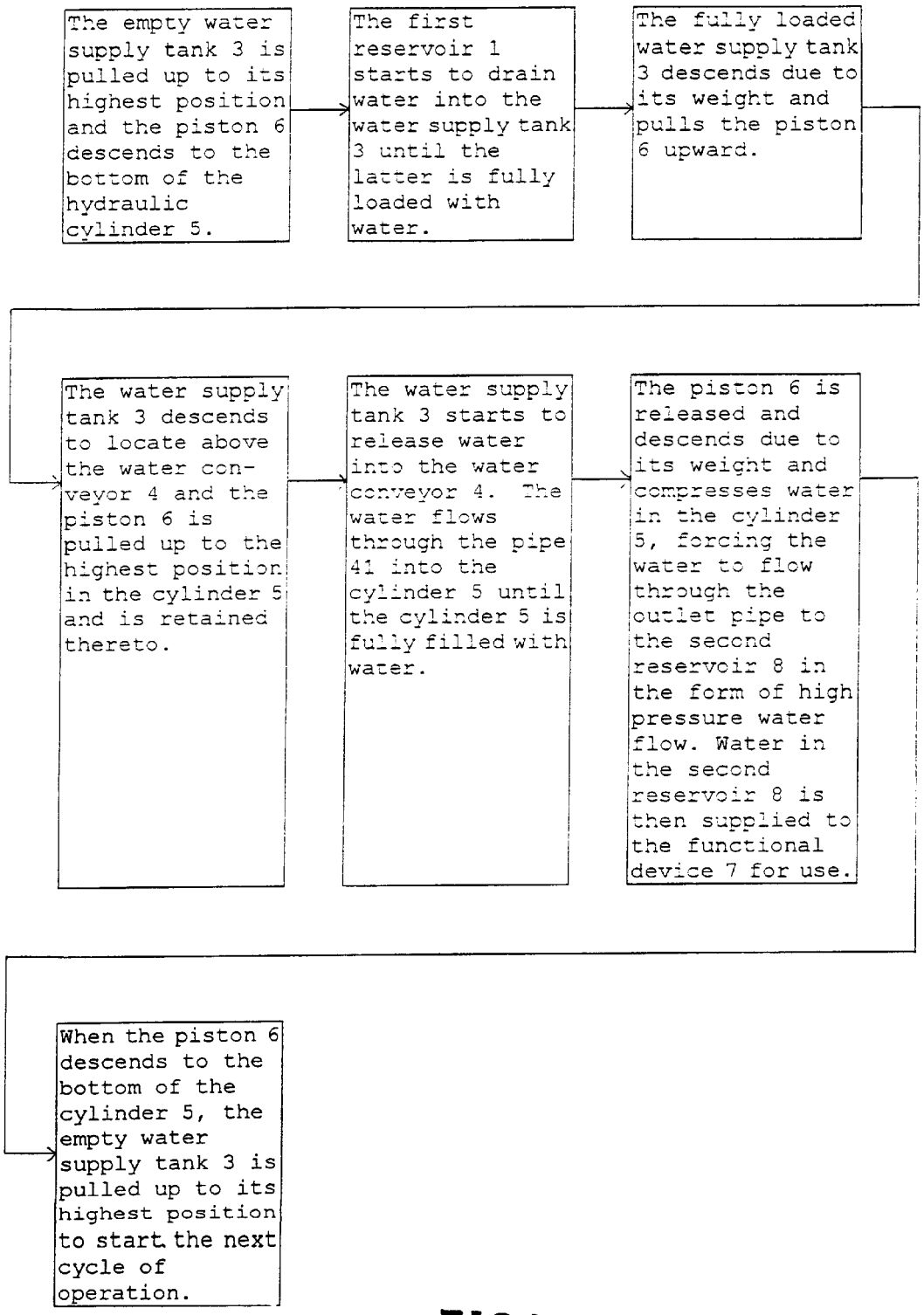
FIG. 1 is a flow chart showing the operating procedures of the present invention.

Please refer to FIGS. 1 to 4 at the same time. The present invention is a simplified energy transforming structure mainly including a first reservoir 1, a pulley assembly 2, a water supply tank 3, a water conveyor 4, a hydraulic cylinder having a heavy piston 6 disposed therein, a matching functional device 7, and a second reservoir 8.

The first reservoir 1 is located at a predetermined high place for storing considerable amount of water therein. Water stored in the first reservoir 1 can be collected in a natural way from rain water or mountain creeks at any time. A first water outlet 11 is provided at a lower level of the first water reservoir 1. The first water outlet 11 can be opened or closed through a first valve 12 connected thereto.

The pulley assembly 2 is firmly fixed to a support (not shown) with the water supply tank 3 hanging from a first pulley at one end of the assembly 2 and the heavy piston 6 hanging from a second pulley at the other end of the assembly 2, such that the water supply tank 3 and the heavy piston 6 may alternately ascend and descent at two ends of the pulley assembly 2. That is, when the water supply tank 3 descends, the pulley assembly 2 acts to pull the heavy piston 6 up. And, when the heavy piston 6 descends, the pulley assembly 2 acts to pull the water supply tank 3 up. To permit this alternately ascending and descending movements, the water supply tank 3 is designed to have a volume matching with a weight of the heavy piston 6. When the water supply tank 3 is empty, the piston 6 is heavier than the tank 3 and can descend without impediment due to its own weight. On the contrary, when the water supply tank 3 is fully loaded with water, it becomes heavier than the piston 6 and can descend without impediment to pull the piston 6 upward at the same time. In brief, the ascending and descending of the water supply tank 3 and the heavy piston 6 separately at two ends of the pulley assembly 2 completely depends on adequate amount of water loaded in the water supply tank 3. The pulley assembly 2 can be specially designed to meet a predetermined scale of the energy transforming structure of the present invention, so that a desired alternately ascending and descending movement can be achieved.

Figure 2:
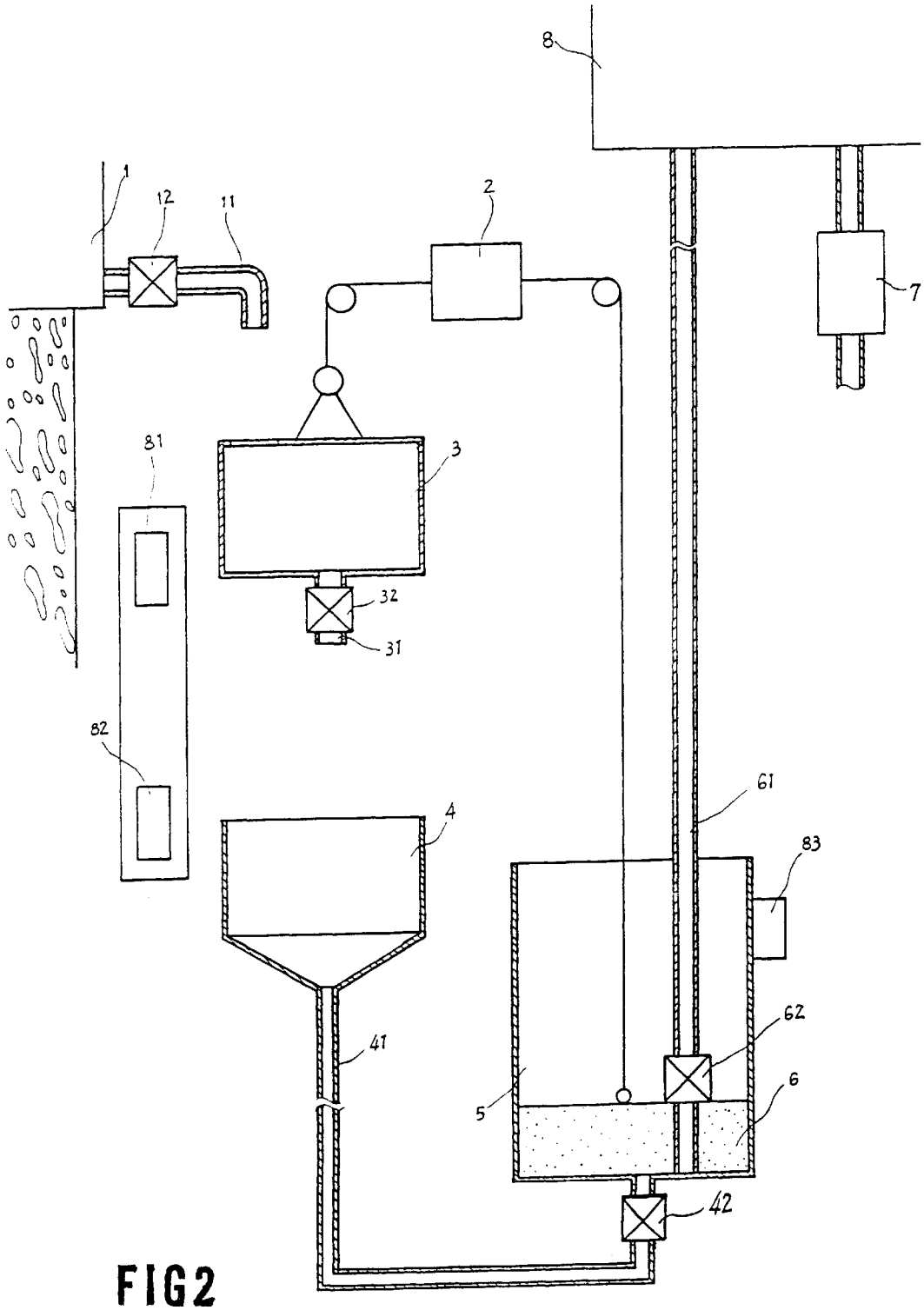
FIG. 2 illustrates the state of the present invention in a first phase of operation thereof.

As shown in FIG. 2, a highest position to where the water supply tank 3 can be pulled is below the first water outlet 11 of the first reservoir 1. At this position, water in the first reservoir 1 can be drained into the tank 3 via the first water outlet 11. A second water outlet 31 and a second valve 32 are provided at a bottom side of the water supply tank 3 to control the releasing of water from the water supply tank 3 to the water conveyor 4.

The water conveyor 4 is in the form of a funnel and is located below the water supply tank 3 for receiving water released from the water supply tank 3. A pipe 41 extends from a bottom of the water conveyor 4 to a bottom of the hydraulic cylinder to communicate with a compression space defined by the hydraulic cylinder 5. A first check valve 42 is connected to the pipe 41 near the bottom of the hydraulic cylinder 5.

The hydraulic cylinder 5 has a properly predetermined diameter with the heavy piston 6 fitly disposed therein, such that the heavy piston 6 can move up and down in the cylinder 5. An outlet pipe 61 having a second check valve 62 connected thereto extends from the heavy piston 6 to the second reservoir 8. When the heavy piston 6 descends without impediment, water in the hydraulic cylinder 5 is compressed and forced to flow out of the hydraulic cylinder 5 via the outlet pipe 61 in the form of high pressure water flow. The high pressure water flow is guided by the outlet pipe 61 to the second reservoir 8 located at a high position before the water flow is sent to the functional device 7 for use.

The functional device 7 generally refers to any device that can utilize high pressure water flow to provide other functions. Spiral blades rotated by high pressure water to generate power and sprinklers rotated by high pressure water to irrigate are examples of functional devices. Different functional devices can be provided and connected to the outlet pipe 61 depending on actual needs. Of course, the outlet pipe 61 may also be directly connected to the functional device 7, so that kinetic energy contained in the high pressure water flowing out of the cylinder 5 is directly converted into works by the functional device 7.

Other control means can be optionally arranged in the structure as necessary. For example, first and second sensors 81, 82 can be provided to detect high and low positions of the water supply tank 3, and retaining means 83 can be provided to cooperate with sensors 81, 82 and first and second valves 12, 32 to cause a series of predetermined movements which will be described later. Since such control means 8 are known skills and can be employed in the present invention to achieve anticipated objects without problem, they are not particularly discussed herein.

Following is a description of the above-mentioned a series of predetermined movements in different phases of operation of the present invention:

1. Movements in First Phase

Please refer to FIG. 2. When the water supply tank 3 is empty, it will be pulled upward by the heavy piston 6 through the action of the pulley assembly 2 and to locate at its highest position while the heavy piston 6 will descend to a lowest position in the hydraulic cylinder 5 because the heavy piston 6 is heavier than the empty tank 3. At this point, the first valve 12 opens to allow water in the first reservoir 1 to flow into the water supply tank 3. When the tank 3 is fully filled with water, the first valve 12 automatically closes. At this point, the fully loaded water supply tank 3 becomes heavier than the heavy piston 6 and begins to descend due to gravity. The descending of the water supply tank 3 gradually pulls up the heavy piston 6 through the pulley assembly 2.

2. Movements in Second Phase

Figure 3:
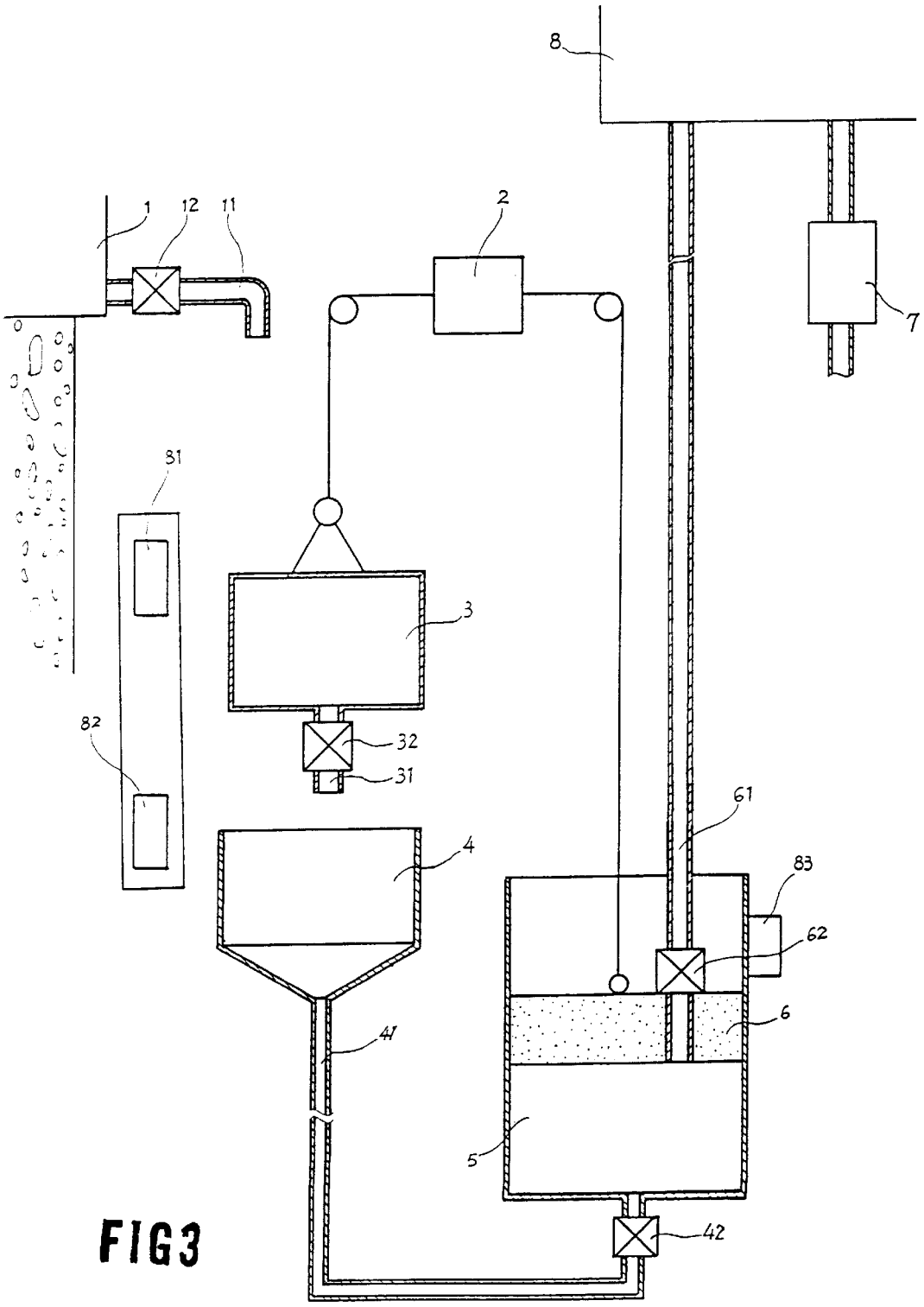
FIG. 3 illustrates the state of the present invention in a second phase of operation thereof.

Please refer to FIG. 3. When the fully loaded water supply tank 3 gradually descends to pull up the heavy piston 6, no other external force is needed. The water supply tank 3 descends simply because it receives water from the first reservoir 1. The entire movements in the second phase are completed through full utilization of natural force and energy and is therefore environmental friendly.

3. Movements in Final Phase

Figure 4:
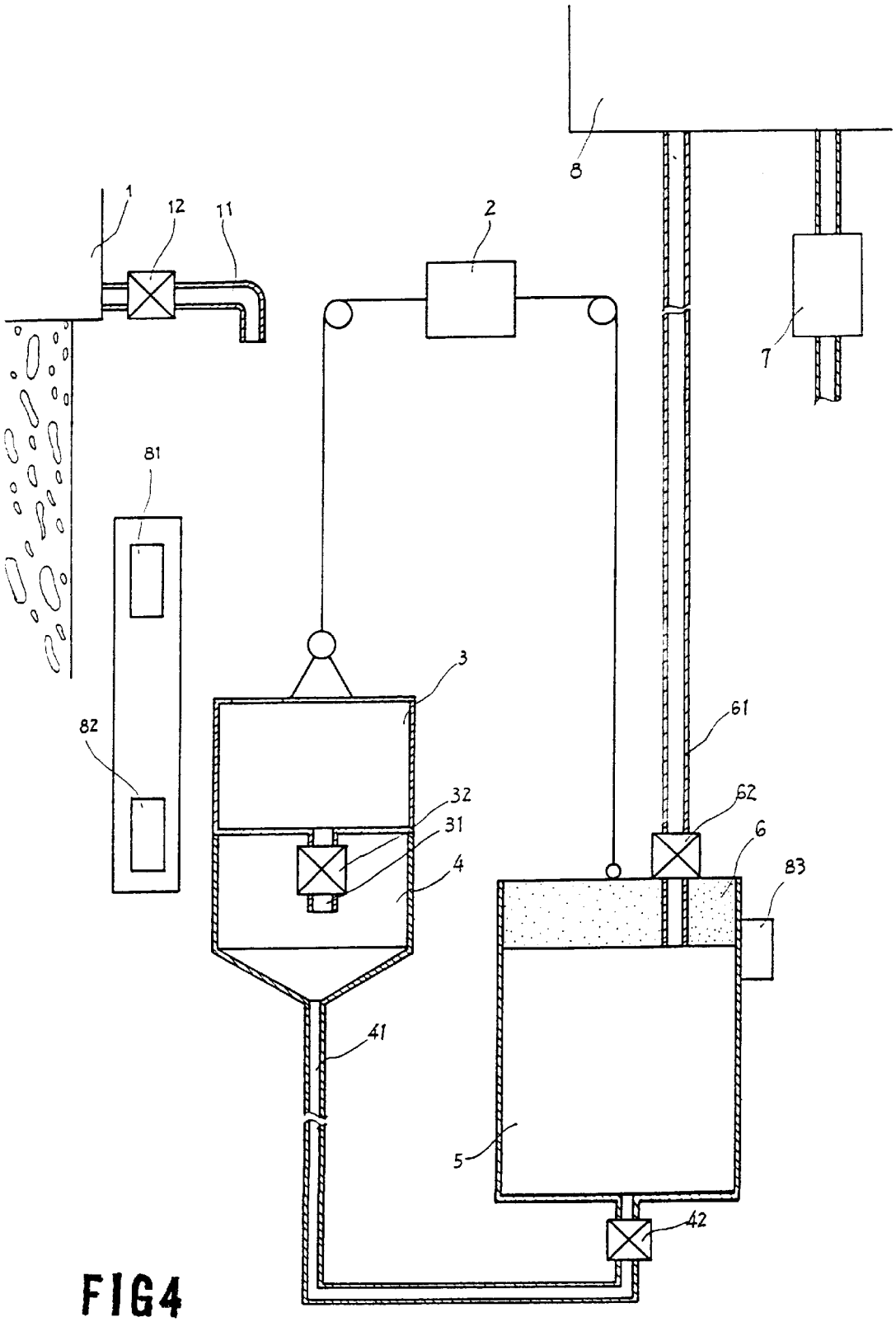
FIG. 4 illustrates the state of the present invention in a final phase of operation thereof.

FIG. 4 illustrates movements in the final phase of the operation of the present invention. In this phase, the water supply tank 3 has descended to its lowest position and the heavy piston 6 has been pulled upward to its highest position in the hydraulic cylinder 5 and is retained thereto by the retaining means 83. At this point, the second sensor 82 detects the lowest position of the water supply tank 3 and causes the second valve 32 to open, allowing the water supply tank 3 to release water to the water conveyor 4 via the second water outlet 31. Water released to the water conveyor 4 keeps flowing through the pipe 41 and the first check valve 42 and into the compression space defined by the hydraulic cylinder 5 and below the heavy piston 6 until the compression space is completely filled with water. To achieve this purpose, the water supply tank 3 may be designed to have a volume equal to a total volume of the compression space and the pipe 4. When the compression space is fully filled with water, the retaining means 83 is caused to release the heavy piston 6. Since the water supply tank 3 is empty now, it becomes lighter than the heavy piston 6 and is pulled upward by the descending heavy piston 6 via the pulley assembly 2. When the heavy piston 6 descends due to its own weight, water in the compression space of the hydraulic cylinder 5 is compressed. The second check valve 42 prevents the compressed water from flowing back into the pipe 41, and the outlet pipe 61 becomes the only way for the water to flow through. Meanwhile, the considerably heavy weight of the piston 6 causes the piston 6 to descend almost without any impediment (the empty water supply tank 3 is the only small resistance to the descending piston 6) and apply considerably high pressure on the water in the hydraulic cylinder 5, forcing the water to flow through the outlet pipe 61 at high pressure. This high pressure water flow is guided upward by the outlet pipe 61 to the second reservoir 8 located at a high position for supplying to a suitable functional device 7 to perform other works.

The whole compression process ends when the heavy piston 6 descends to the lowest position in the hydraulic cylinder 5. By now, the structure of the present invention has completed one cycle of its operation for the water collected in and released from the first reservoir 1 to complete its function. The water supply tank 3 is pulled to its highest position below the water outlet 11 and ready for receiving the next release of water from the first reservoir 1 to start another cycle of energy transforming operation.

With the simplified structure of the present invention, the movements in the first, the second, and the final phases of operation keep cycling to transform potential energy of water stored in the first reservoir 1 at a high position into kinetic energy to achieve other functions.

The time separately needed for water to flow from the first reservoir 1 to fully fill the water supply tank 3 and from the water supply tank 3 via the water conveyor 4 and pipe 41 to fill the hydraulic cylinder 5 seem to cause pauses or interruptions in the operation of the structure of the present invention. To overcome these interruptions in operation, multiple units of similar structure shown in the figures can be used at the same time. When the time needed to fill water supply tanks 3, water conveyors 4, pipes 41, and hydraulic cylinders 5 of every units of the structure, that is, interruptions in the operation of every units of the structure, are so arranged that there are always sufficient units of energy transforming structure in operating to continuously send water to the second reservoir 8 and then the functional device 7 for the functional device 7 to work at anytime. This is similar to the condition in an automotive engine in which multiple cylinders and crankshafts cooperate with one another to keep the engine running.

Figure 5:
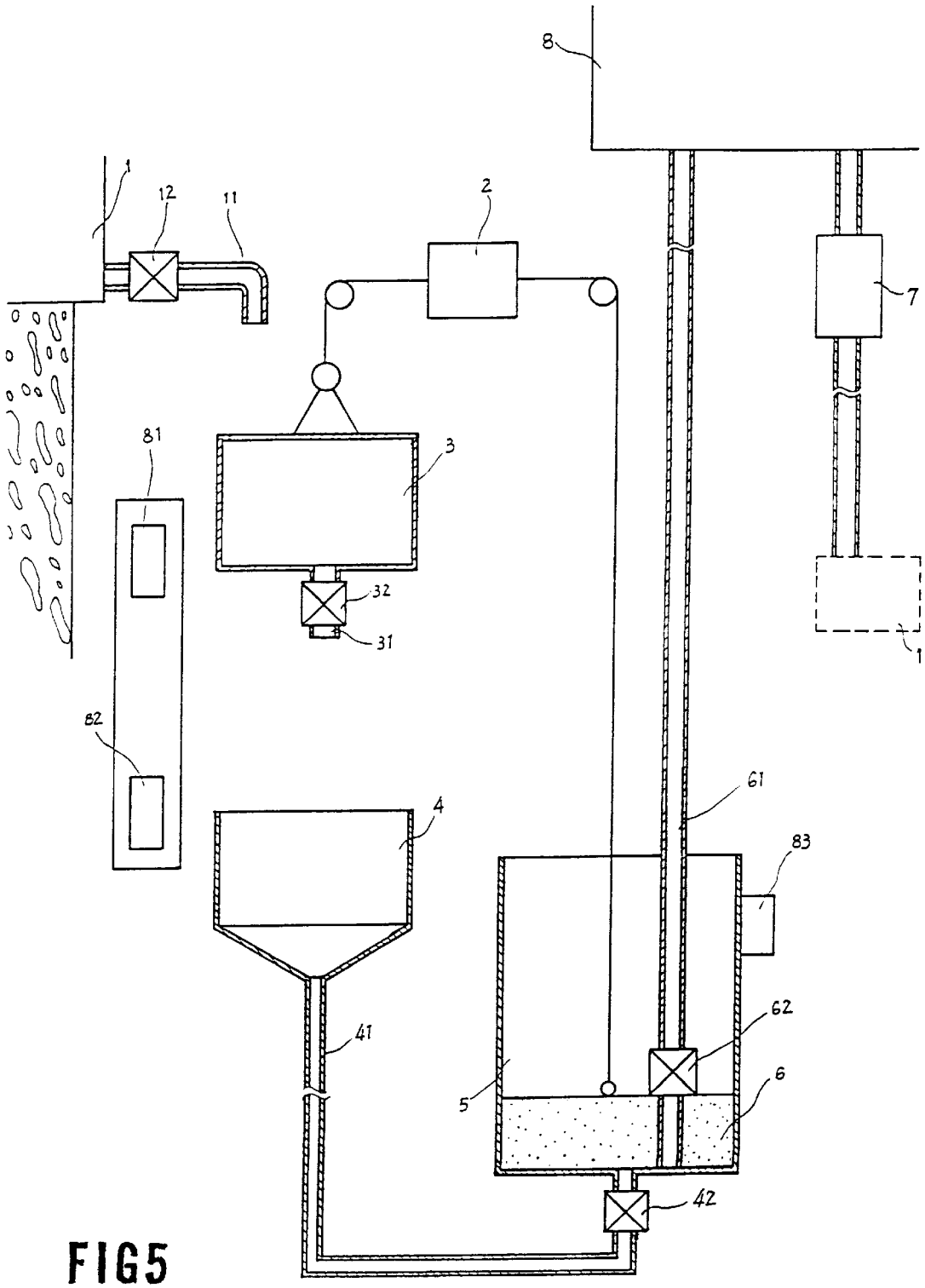
FIG. 5 illustrates another embodiment of the present invention.

FIG. 5 illustrates another embodiment of the present invention. In this embodiment, the outlet pipe 61 leading to the second reservoir 8 and the functional device 7 keeps extending from the functional device 7 to the first reservoir 1. Due to frictional contacts at the pulley assembly 2, resistance of pipe walls to the water flow, necessary energy consumption by the functional device 7 to work, etc., a part of the potential energy of the water stored in the first reservoir 1 is consumed when the water flows through the water supply tank 3, the water conveyor 4, the pipe 41, the hydraulic cylinder 5, the outlet pipe 61, and the functional device 7 and returns to the first reservoir 1. This causes loss of a part of water released from the first reservoir 1 before the water flows back to the first reservoir 1 via the outlet pipe 61. However, a large part of the water can still be sent back to the first reservoir 1 for recycling if there is good control over the whole operation of the structure to avoid unnecessary waste of energy.

It is a known principle that a potential energy can be transformed into a kinetic energy. Water stored at a high position is full of potential energy that can be used to generate another form of energy for other purpose, such as hydraulic power generation. The present invention employs the same energy transforming principle but has a much more simplified structure. In the present invention, a large volume of water stored at a high position and therefore full of high potential energy is directly used to pull up the heavy piston in the hydraulic cylinder. And then, the weight of the heavy piston is used to compress the water which has previously been used to pull the piston upward, so that the water is forced to flow through the predetermined outlet pipe in the form of high pressure flow full of kinetic energy. The potential energy of the water in the first reservoir 1 has apparently been well utilized in a planned manner to achieve expected effects. Although there is still a small amount loss of energy during the whole operation of the present invention, the present invention provides a feasible way to conveniently and efficiently transform potential energy into kinetic energy for more useful works.

What is claimed is:

1. A simplified energy transforming-structure comprising a first reservoir, a pulley assembly, a water supply tank, a water conveyor, a hydraulic cylinder having a heavy piston therein, a second reservoir, and a matching functional device; said first reservoir being provided at a high position in said structure for collecting and storing water full of potential energy, a water outlet being provided to said first reservoir for releasing water into said water supply tank; said water supply tank hanging from a first pulley at one end of said pulley assembly and said piston hanging from a second pulley at another end of said pulley assembly opposite to said water supply tank; said water conveyor being distantly located below said water supply tank for receiving water released from said water supply tank and having a pipe with a first check valve connected thereto for conveying water to said hydraulic cylinder; said piston being movable up and down in said hydraulic cylinder and having a weight heavier than said water supply tank in an empty state but lighter than said water supply tank in a fully loaded state, and an outlet pipe with a second check valve connected thereto extending from said hydraulic cylinder to said second reservoir which is also located at a high position in said structure, so that said hydraulic cylinder is communicable with said second reservoir; whereby when said water supply tank is in empty state, it is pulled up by said piston through said pulley assembly to locate below said water outlet of said first reservoir for receiving water released from said first reservoir, and when said water supply tank is fully loaded with water, it descends to pull up said piston at another end of said pulley assembly until said piston is raised to a top of said hydraulic cylinder and is retained thereto by a retaining means; and at this point, said water supply tank starting to release water into said water conveyor, so that water flows through said pipe and into said hydraulic cylinder; and when said water supply tank becoming empty again, said piston being released from said retaining means to freely descend in said hydraulic cylinder, compressing and forcing water in said hydraulic cylinder to flow through said outlet pipe into said second reservoir from where high-pressure water flow full of kinetic energy is supplied to said functional device for said functional device to work.

2. A simplified energy transforming structure as claimed in claim 1, wherein each said structure constitutes a unit and multiple units of said structure can be arranged together to form an integral apparatus to provide continuous transformation of water potential energy into kinetic energy without interruption.

* * * * *